United States Patent [19]

Ritti et al.

[11] 4,056,459

[45] Nov. 1, 1977

[54] ANODE ASSEMBLY FOR AN ELECTROLYTIC CELL

[75] Inventors: Stelio Ritti, Rome; Silvio Policardi, Ferrare, both of Italy

[73] Assignee: Solvay & Cie, Brussels, Belgium

[21] Appl. No.: 675,492

[22] Filed: Apr. 9, 1976

[30] Foreign Application Priority Data

Apr. 25, 1975 France ..... 75.13313

[51] Int. Cl.[2] ..... C25B 1/26; C25B 9/02

[52] U.S. Cl. ..... 204/286; 204/256; 204/288

[58] Field of Search ..... 204/286, 288, 281, 289, 204/297 R, 267, 275, 256, 254

[56] References Cited

U.S. PATENT DOCUMENTS

| | | | |
|---|---|---|---|
| 3,612,751 | 10/1971 | Adaev et al. | 204/286 X |
| 3,700,582 | 10/1972 | Giacopelli | 204/275 |
| 3,743,592 | 7/1973 | Metcalff | 204/286 X |
| 3,761,384 | 9/1973 | Ruthel et al. | 204/288 |
| 3,847,783 | 11/1974 | Giacopelli | 204/286 X |

*Primary Examiner*—Arthur C. Prescott

*Attorney, Agent, or Firm*—Robert E. Burns; Emmanuel J. Lobato; Bruce L. Adams

[57] ABSTRACT

An anode assembly having upstanding anode plates either clamped between metallic beams or on metallic bars between the metallic beams. The beams and the bars are covered with fluid-tight caps made of a sheet material with downwardly bent marginal edge portions disposed on longitudinal grooves on the sides of the beams and bars. These grooves extend axially of the beams and bars and are open to the sides and to the top of the individual beams and bars. The grooves of two next successive beams define a dovetail groove narrower at the top adjacent the caps and are filled with a sealing material to define sealing joints so that the assembly has a fluid-tight upper surface of the base.

16 Claims, 5 Drawing Figures

ANODE ASSEMBLY FOR AN ELECTROLYTIC CELL

The present invention is directed to improving electrolytic cells with interleaved vertical electrodes, for example cells intended for the production of alkali metal chlorate or hypochlorite or for the production of chlorine.

The invention relates more particularly to an assembly of metal anodes for a cell of this type.

In Belgian Pat. No. 755900 of the Sept. 9, 1970, in the name of the present applicant, there is proposed an anode assembly which comprises substantially vertical and parallel metal anode plates, engaged and clamped between vertical metal beams forming a vertical sidewall of an electrolytic cell. The beams, serving also as current conductors to the anodes, are made of steel or of another metal with good electrical conductivity, and are covered with a coating protecting them against the corrosive action of the electrolyte, for example a layer of chlorinated polyvinyl chloride.

In Belgian Pat. No. 812704 of Mar. 22, 1974, in the name of the present applicant, there is described a bipolar electrode consisting of an assembly of substantially vertical and parallel anode plates, inserted and clamped between steel beams carrying cathodes. On their anterior surface facing towards the anode, the beams are covered with a coating protecting them against the corrosive action of the electrolyte, such as a layer of concrete in which the binder consists of a polyester resin resistant to chlorine.

In the above-mentioned known assemblies, the protective layer which covers the assembly of the beams is severely stressed in service by the expansion of thermal origin in the beams and the anodes, so that it rapidly tends to crack locally, leading to infiltration of electrolyte to the beams and to corrosion of these.

The applicant has now found an anode assembly of particularly easy construction which is permanently fluid-tight.

SUMMARY OF THE INVENTION

The invention provides an anode assembly for an electrolytic cell with interleaved vertical electrodes, comprising substantially vertical and parallel anode plates, supports for the anode plate and metal beams inserted between the supports and forming with them a unit of fluid-tight wall, characterised in that the assembly comprises also fluid-tight caps which cover the anterior surface of the beams facing towards the anode plates, and sealing joints interposed between the caps and the supports.

In the anode assembly according to the invention, the metal beams, clamped between the supports for the anode plates, ensure the rigidity of the assembly; the protection of the beams against the corrosive action of the electrolyte is ensured by the caps and the joints, these last ensuring also the fluid-tightness of the assembly.

In the anode assembly according to the invention, the caps of the beams are little affected by the expansion of the beams and the anode supports, the expansion being compensated by elastic deformation of the caps and compression of the ceiling joints, thus reducing the risks of cracking of the caps and failure of the fluid-tightness of the anode assembly.

The anode assembly according to the invention offers, moreover, the advantage of being easy and rapid of construction. It is in fact possible to prefabricate the caps, for example by folding a sheet and then fitting it on to the beams, then assembling the beams and the supports while placing the joints between them.

The invention has the additional advantage of permitting rapid dismantling of the anode assembly, with possible recovery of the beams, the anode plates, the joints and the caps.

Another advantage of the anode assembly according to the invention resides in the possibility of manufacturing separately and in turn its different constituent parts, that is the beams, the caps, the joints, the anode plates and their supports.

In the anode assembly according to the invention, the beams may have any cross section compatible with efficient clamping of the supports between them, so as to produce a rigid unitary assembly. They may for example have the shape of bars of rectangular or square transverse cross section, or be of inverse U-shape.

The beams are preferably made of a metal or alloy of good electrical conductivity, for example of steel, copper or aluminium.

The anode plates are advantageously plates of a film-forming material carrying an active coating.

By film-forming material is meant a metal selected from the group consisting of titanium, tantalum, niobium, tungsten and zirconium and the alloys of these metals having anodic polarisation properties comparable to those of titanium.

The active coating of the anode plates is a conducting coating which catalyses the anode reaction in the electrolytic cell. The active coating may for example be selected from the metals of the platinum group such as platinum, iridium, osmium, palladium, rhodium and ruthenium, their alloys and their compounds, especially their oxides.

The supports for the anodes plates may consist of extensions of these plates and not constitute separate members.

As a modification, they may consist of metal bars fixed to the ends of the anode plates and inserted between the beams. They then contribute towards ensuring the rigidity of the assembly.

The fluid-tight caps of the beams may be made of any material that is inert under the conditions ruling in the electrolytic cell. They may advantageously be formed by folding a sheet made of titanium, tantalum, niobium, tungsten, zirconium, or of an alloy of one or more of these metals having anodic polarisation properties comparable to those of titanium.

As a modification, the caps of the beams may equally well be formed from a sheet of synthetic material that resistant to corrosion, for example of chlorinated polyvinyl chloride or a fluorinated polymer such as polytetrafluoroethylene.

The sealing joints may be made of any elastic material that is inert under the conditions ruling in the electrolytic cell. They may for example be made of a synthetic rubber such as an elastomeric copolymer of ethylene and propylene known under the trade mark DUTRAL (Montecatini-Edison) or an elastomeric copolymer of vinylidene fluoride and hexafluoropropene known under the trade mark VITON (E I Du Pont de Nemours & Co).

In a preferred embodiment of the invention, each beam of the anode assembly has two longitudinal grooves facing the supports which are disposed on opposite sides of the beam; the caps of the beams are engaged in these grooves and the joints are compressed in the grooves between the caps and the supports. This preferred embodiment of the invention ensures that a rigid anode assembly is obtained independently of the compressive forces exerted on the sealing joints. It thus has the appreciable advantage of allowing the use of joints compressed to less than their elastic limit, between the beams and the supports, thus reinforcing the fluid-tightness of the assembly, reducing the stresses on the joints in service, and increasing their lifetime.

In this embodiment of the anode assembly according to the invention, the grooves in the beams are shaped so as to ensure efficient retention of the joints against the hydrostatic pressure ruling in the cell.

In order to simplify the cross section of the caps, ease the insertion of the joints in the grooves of the beams during construction of the assembly, and ensure efficient retention of the joints, the grooves are advantageously contrived in the beams so that they are open through the anterior face of the beams, facing towards the anodes, the beams having for example a rectangular or trapezoidal section between their two grooves.

In this embodiment of the invention, the beams preferably have, between their two grooves, a transverse section of dovetail shape, increasing towards the anterior surface of the beams, so as to render uniform the compression of the joints in the groove.

In a modified embodiment of the invention, where the supports for the anode plates comprise bars inserted between the beams, longitudinal slots may be provided in the bars, in which the sealing joints are engaged.

The anode assembly according to the invention finds an advantageous application in electrolytic cells of the unipolar type, one wall of which, for example the base wall, is then made up of the assembly of beams, supports, caps and sealing joints. In this particular case, the beams and/or the supports for the anode plates may be extensions of conducting bars leading in the electric current and may serve to distribute the current to the anodes.

In a modification, the beams may form a vertical lateral wall or the cover of the cell.

In one particular embodiment of the anode assembly according to the invention, the beams and/or the supports for the anode plates carry substantially vertical and parallel cathodes on their rear face with respect to the anodes, so as to form a bipolar electrode.

This particular embodiment of the anode assembly according to the invention finds an application in electrolysers of the bipolar type such as, for example, that described in the above-mentioned Belgian Pat. No. 812,704.

BRIEF DESCRIPTION OF THE DRAWINGS

Special features and details of the invention will become evident from the following description of the accompanying drawings, which show, by way of example only, some embodiments of the assembly according to the invention.

DESCRIPTION OF THE PREFERRED EMBODIMENTS

Figure 1:
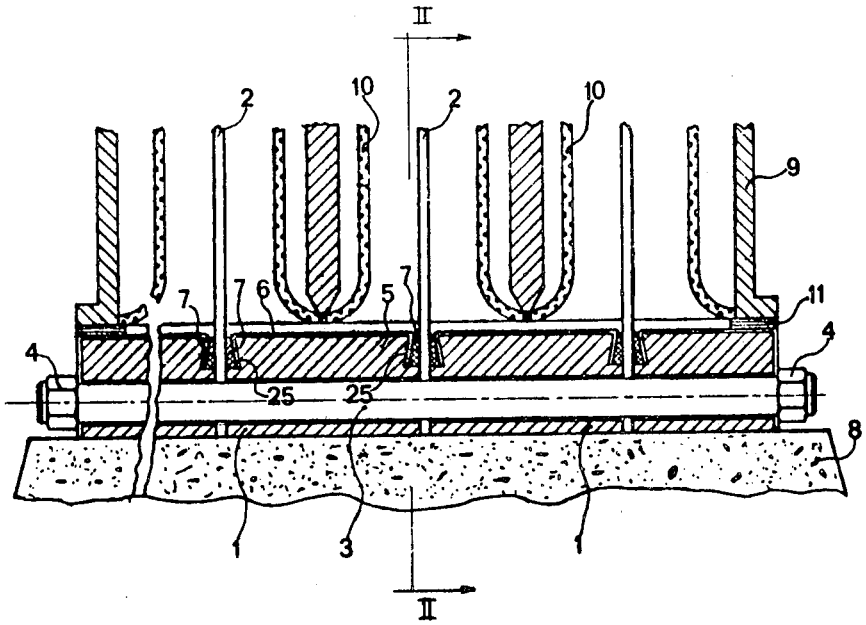
FIG. 1 shows in part transverse vertical section a diaphragm cell equipped with a first embodiment of the anode assembly according to the invention.

In these figures the same reference numerals indicate identical components.

Figure 2:
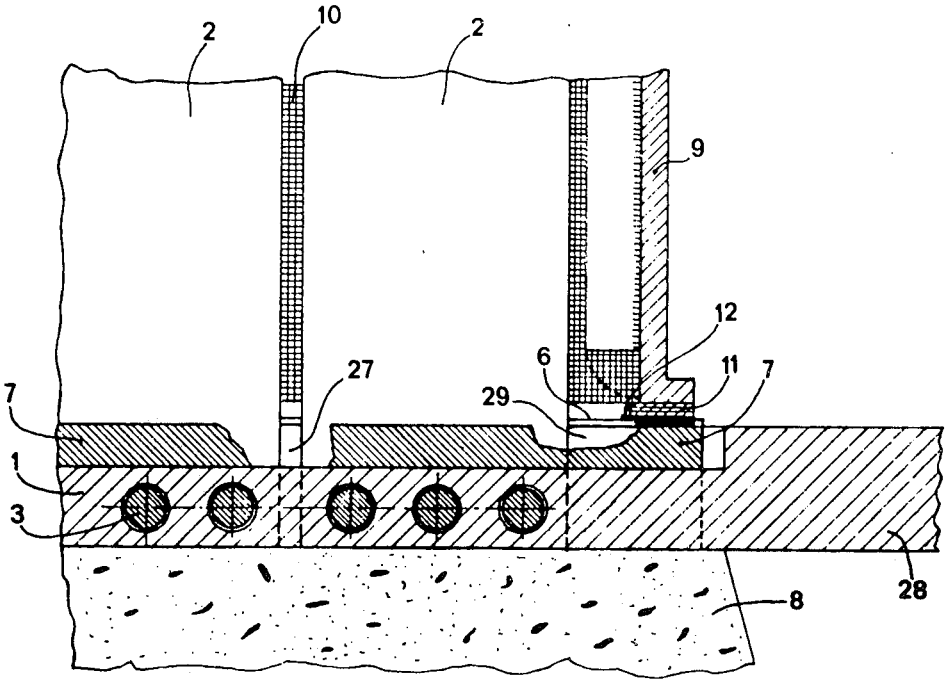
FIG. 2 is a section in the plane II—II of FIG. 1, partially cut-away.

In FIGS. 1 and 2 is shown a first embodiment of the anode assembly according to the invention. This comprises a series of horizontal beams 1 made of copper, between which plates 2 of titanium are inserted vertically. The beams 1 and the plates 2 are held together as a rigid unit assembly by means of a series of threaded rods 3 and clamping nuts 4, made for example of steel.

The upper portions of the plates 2, which project above the beams 1 constitute the anodes proper of the anode assembly. For this purpose they are covered with a conducting coating which catalyses the discharge of halide ions, for example, a coating containing a metal of the platinum group or an oxide of a metal of the platinum group.

The anterior part of the beams 5, facing towards the anodes, is given a dovetail shape, so as to define two longitudinal grooves 25 facing the plates 2.

Titanium caps 6 cover the surface of the anterior part 5 of the beams and have their longitudinal edges turned over and inserted in the grooves 25. Trapezoidal sealing joints 7 are compressed elastically in the grooves 25, between the plates 2 and the edges of the caps 6.

The joints 7 are made of an elastic material which is resistant to corrosion in the presence of an electrolyte such as an aqueous solution of alkali metal chloride. They are for example made of an elastomeric copolymer of ethylene and propylene known under the trade mark DUTRAL (Montecatini-Edison) or an elastomeric copolymer of vinylidene fluoride and hexafluoropropene known under the trade mark VITON (E I du Pont de Nemours & Co).

In a modification, in order to increase the fluid-tightness of the anode assembly, the plates 2 of each row of anodes are joined to each other by small connecting plates 27 made of titanium, extending between the joints 7. Similar small plates 29 made of titanium may extend the plates 2 at the end of the rows of anodes.

In FIGS. 1 and 2, the beams 1 are seated on a foundation 8, made for example of reinforced concrete, and constituting, along with the joints 7 and the caps 6, the fluid-tight baseplate of a diaphragm cell suitable, for example, for the electrolysis of a sodium chloride or potassium chloride brine. A peripheral enclosure 9 made of steel is placed on the beams 1, around the plates 2, and carries cathodes 10 in the form of pockets with foraminate walls, which alternate with the anodes and are covered by a diaphragm, not shown.

Fluid-tightness between the enclosure 9 and the beams 1 is ensured, in known manner, by means of a flexible peripheral joint 11.

At the ends of the beams 1, the caps 6 and the joints 7 may advantageously be covered with a flexible and fluid-tight film 12 beneath the peripheral joint 11. The joint 12 may for example consist of an elastomer poured over the ends of the caps 6 and the joints 7 and polymerised in situ at ambient temperature, for example a butyl rubber known under the name LORIVAL (Lorival Limited, Bolton, England).

This embodiment of the invention improves the fluid-tightness of the cell under the transverse walls of the enclosure 9.

In the cell of FIGS. 1 and 2, the beams 1 made of copper serve for feeding the anode plates 2 with current. For this purpose, the beams 1 are advantageously extended by copper bars 28, which project out of the cell for connection to a current lead.

In order to reduce the contact resistance between the beams 1 and the plates 2, the latter may be coated over their lower part which is in contact with the beams, with a conducting coating such as platinum, for example.

In a modified embodiment, not shown, of the anode assembly of FIGS. 1 and 2, the beams 1 are held between the plates 2 by means of hollow bolts screwed into each other, in the manner described in the above-mentioned Belgian Pat. No. 755900.

Figure 3:
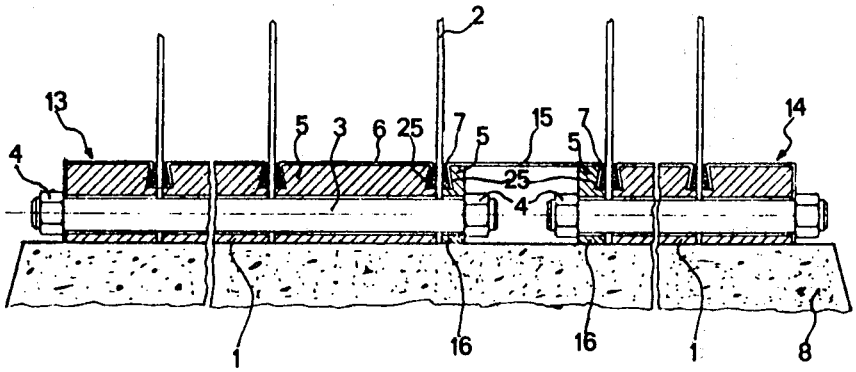
FIG. 3 shows in transverse vertical section a second embodiment of the anode assembly according to the invention.

In the embodiment shown in FIG. 3, the anode assembly according to the invention is made up of two rigid unit assemblies 13 and 14, each analogous to the anode assembly of FIGS. 1 and 2.

The two unit assemblies 13 and 14 are seated side by side on a foundation 8 and are connected to each other by a long sheet 15 of titanium, the edges of which are turned over and inserted in the longitudinal grooves 25 of the end beam 16 of the two assemblies 13 and 14. Trapezoidal joints 7 ensure fluid-tightness of the anode assembly on both sides of the sheet 15.

This particular embodiment of the invention has the advantage of reducing, all other things being the same, the stresses of thermal origin in the assembly, these stresses being partly absorbable by deformation of the sheet 15. This embodiment allows the manufacture of large sized anode assemblies, by placing side by side several rigid unit assemblies 13, 14, connected to each other by fluid-tight sheets 15.

Figure 4:
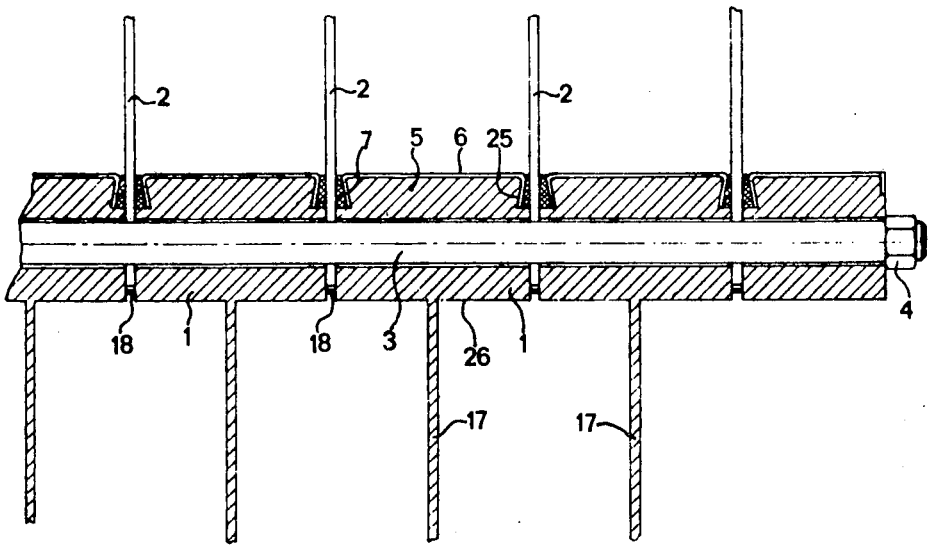
FIG. 4 shows in transverse vertical section a third embodiment of the anode assembly according to the invention, contrived as a bipolar electrode.

In the embodiment shown in FIG. 4, the beams 1 of the anode assembly are made of steel and carry cathodes 17 on their rear face 26, so as to form a bipolar electrode.

Sealing joints 18 may be inserted between the beams 1, in line with the titanium plates 2, in order to avoid corrosion of these plates in contact with the hydrogen produced at the cathode.

In FIG. 4, the cathodes 17 consist of steel plates integral with the beams 1, the bipolar electrode formed thereby being suitable for example for the production of alkali metal chlorate.

In a modification, the cathodes may be formed by fingers with foraminate walls, suitable for covering with a diaphragm, so as to constitute a bipolar electrode analogous to those described in the above-mentioned Belgain Patent 812704 and suitable for example for the production of chlorine.

Figure 5:
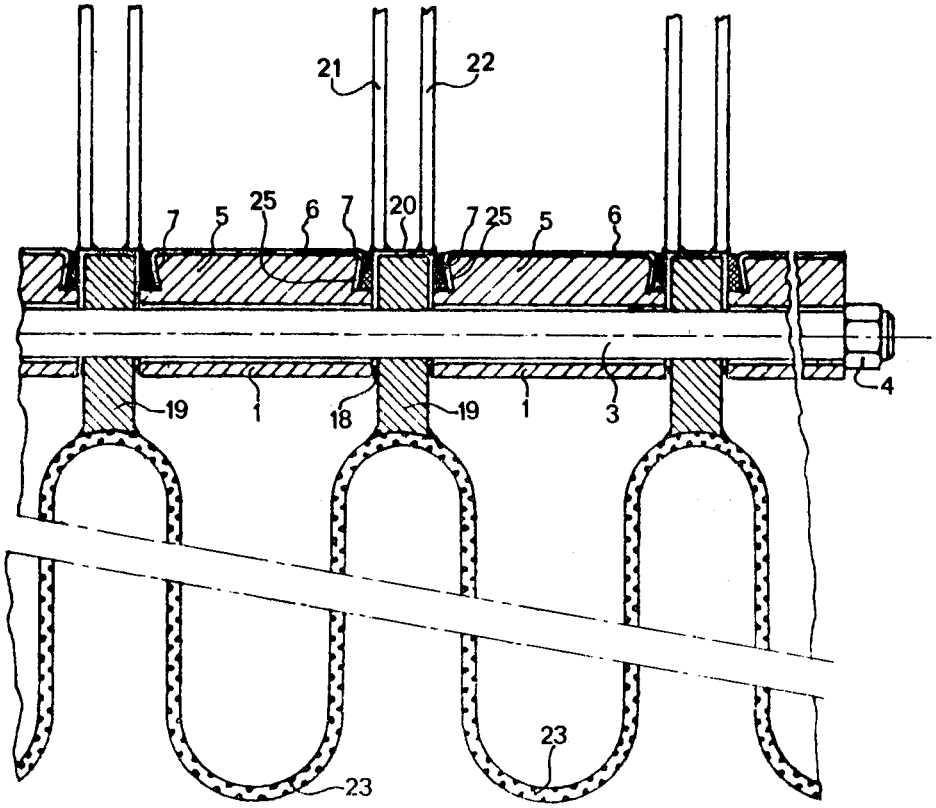
FIG. 5 shows in transverse vertical section a fourth embodiment of the anode assembly according to the invention, contrived as a bipolar electrode.

In the embodiment shown in FIG. 5, the beams 1 of the anode assembly are made of steel and alternate with steel bars 19, which are covered with a titanium cap 20 and serve as supports for the anodes. Each of the anodes is formed by a pair of parallel plates made of titanium 21 and 22, optionally foraminate, placed opposite to each other and soldered on to the cap 20 of their support 19. Sealing joints 7 are compressed elastically in the grooves 25 of the beams between the caps 6 and 20, so as to ensure fluid-tightness of the anode assembly.

On their opposite face to the cap 20, the steel bars 19 carry cathodes 23 in the form of pockets with foraminate walls suitable for covering with a diaphragm. These cathodes may advantageously formed by an undulating steel lattice, soldered to the bars 19.

Sealing joints 18 may be inserted between the beams 1 and the bars 19, in line with the titanium caps 20, so as to avoid corrosion of the caps by contact with the hydrogen liberated at the cathodes 23.

The invention is clearly not limited to the embodiments that have just been described, numerous modifications of the invention being possible.

We claim:

1. An anode assembly for an electrolytic cell comprising, a plurality of upstanding parallel anode plates spaced from each other, support means for supporting the anode plates and for providing electrical current thereto comprising metallic beams between the anode plates, fluid-tight caps over the beams having bent marginal edge portions bent downwardly along the sides opposed to the anode plates, each beam having on opposite longitudinal sides thereof grooves open to the top of the beams and to the sides thereof, said bent marginal edge portions of each cap being bent into the longitudinal side grooves of the corresponding beam covered by the respective cap, a sealing material along the bent marginal edge portions on a side thereof toward the individual anode plates defining sealing joints.

2. An anode assembly for an electrolytic cell according to claim 1, in which said beams clamp the anode plates therebetween and in which said beams next adjacent to said anode plates define jointly a longitudinal groove within which said sealing material is disposed on opposite sides of the anode plates clamped between next adjacent beams between the sealing joints.

3. An anode assembly for an electrolytic cell according to claim 2, in which the grooves defined jointly by next adjacent beams have a dovetail cross section and said grooves are narrower toward the caps.

4. An anode assembly for an electrolytic cell according to claim 1, in which said support means comprise extensions on said anode plates for supporting the anodes, said extensions being disposed between next adjacent beams.

5. An anode assembly for an electrolytic cell according to claim 4, including connecting plates joining together said extensions between sealing joints.

6. An anode assembly for an electrolytic cell according to claim 4, in which said extensions comprise metallic bars, caps covering said bars having bent portions along the sides thereof between the bars and said sealing material of said sealing joints.

7. An anode assembly for an electrolytic cell according to claim 6, in which each bar has a pair of laterally spaced anode plates disposed upstanding thereon.

8. An anode assembly for an electrolytic cell according to claim 7, in which said anode plates on said bars are welded onto said caps thereof, and welds welding the anode plates to the respective bar caps.

9. An anode assembly for an electrolytic cell according to claim 1, in which said sealing joints are compressed short of their elastic limit.

10. An anode assembly for an electrolytic cell according to claim 1, in which said caps comprise sheet made of a material selected from the group consisting of niobium, zirconium, and alloys of both metals.

11. An anode assembly for an electrolytic cell according to claim 1, in which said anode plates, said caps thereon, and said supports including said beams are arranged as two rigid units laterally spaced, and a fluid-tight sheet between the two units having downwardly bent marginal edge portions fitting into corresponding ones of said grooves and in sealing contact with said sealing material.

12. An anode assembly for an electrolytic cell according to claim 1, in which said beams are disposed substantially horizontally.

13. An anode assembly for an electrolytic cell according to claim 1, in which said beams comprise conductive extensions of conductors for applying current to the anode plates.

14. An anode assembly for an electrolytic cell according to claim 1, in which said supports comprise metallic bars supporting the anodes, said bars being disposed between next successive beams, and said bars having cathodes on faces thereof opposite to faces on which the upstanding cathode plates are supported.

15. An anode assembly for an electrolytic cell according to claim 14, in which said cathodes comprise pocket configurations having foraminate walls, whereby bipolar electrodes are defined.

16. An anode assembly for an electrolytic cell according to claim 1, including an elastomer about the periphery of the assembly polymerized in situ. to effect a seal between the assembly and walls of a cell.

* * * * *